US010543950B2

(12) United States Patent
Hammond et al.

(10) Patent No.: US 10,543,950 B2
(45) Date of Patent: Jan. 28, 2020

(54) PACKAGING WITH OUTER SLEEVE AND SLIDER

(71) Applicant: Multi Packaging Solutions UK Limited, Nottingham (GB)

(72) Inventors: Carol Lynn Hammond, Nottingham (GB); Nigel Davis, Nottingham (GB)

(73) Assignee: Multi Packaging Solutions UK Limited, Nottingham (GB)

( * ) Notice: Subject to any disclaimer, the term of this patent is extended or adjusted under 35 U.S.C. 154(b) by 0 days.

(21) Appl. No.: 15/457,325

(22) Filed: Mar. 13, 2017

(65) Prior Publication Data

US 2017/0267396 A1 Sep. 21, 2017

(30) Foreign Application Priority Data

Mar. 15, 2016 (GB) ..... 1604411.7

(51) Int. Cl.
*B65D 5/38* (2006.01)
*B65D 50/04* (2006.01)
(Continued)

(52) U.S. Cl.
CPC ..... *B65D 5/38* (2013.01); *B65D 50/045* (2013.01); *B65D 75/367* (2013.01); *B65D 77/02* (2013.01);
(Continued)

(58) Field of Classification Search
CPC ..... B65D 5/38; B65D 50/045; B65D 77/02; B65D 75/367; B65D 2215/02;
(Continued)

(56) References Cited

U.S. PATENT DOCUMENTS 6,230,893 B1 5/2001 Karow
6,491,211 B1 12/2002 Evans et al.
(Continued)

FOREIGN PATENT DOCUMENTS

WO WO2013151806 A1 10/2013
WO WO2015066109 A1 5/2015

OTHER PUBLICATIONS

EP search report for EP17160632.0 dated Aug. 2, 2017.

*Primary Examiner* — Jacob K Ackun
*Assistant Examiner* — Jenine Pagan
(74) *Attorney, Agent, or Firm* — O'Shea Getz P.C.

(57) ABSTRACT

A package includes an outer sleeve and a slider for holding a blister pack slidably mounted within the outer sleeve. The outer sleeve includes a wall having an outer panel and an inner panel. The inner panel has a locking edge formed at a terminal end thereof spaced from and facing a closed end of the sleeve. A locking flap is formed at a terminal end of the slider extending in a direction away from a closed end of the outer sleeve for engagement with the said wall of the outer sleeve. The flap has a free edge for engagement with the locking edge of the inner panel to prevent the slider from being removed from the outer sleeve when the slider is fully received within the outer sleeve. The outer panel of the outer sleeve includes a release button at least partially overlapping the flap of the slider when the slider is fully inserted in the outer sleeve, and being pressable so as to disengage the free edge of the slider flap from the locking edge of the outer sleeve wall to permit the slider to be withdrawn from the outer sleeve.

12 Claims, 6 Drawing Sheets

(51) Int. Cl.
*B65D 75/36* (2006.01)
*B65D 77/02* (2006.01)

(52) U.S. Cl.
CPC .. *B65D 2215/02* (2013.01); *B65D 2583/0454* (2013.01)

(58) Field of Classification Search
CPC ..... B65D 2583/0454; B65D 75/327; B65D 2583/0463; B65D 2215/00
USPC ..... 206/531, 539, 538, 528, 1.5; 229/125.125
See application file for complete search history.

(56) References Cited

U.S. PATENT DOCUMENTS

| | | | | |
|---|---|---|---|---|
| 8,939,281 | B2 * | 1/2015 | Matsuba | B65D 83/0463 206/1.5 |
| 9,376,246 | B2 * | 6/2016 | Jones | B65D 75/368 |
| 2006/0131205 | A1 * | 6/2006 | Sandberg | B65D 5/38 206/538 |
| 2007/0054525 | A1 * | 3/2007 | Jones | B65D 5/38 439/159 |
| 2008/0314780 | A1 | 12/2008 | Weston | |
| 2009/0184023 | A1 * | 7/2009 | Brollier | A61J 1/035 206/531 |
| 2012/0012497 | A1 | 1/2012 | Weston et al. | |
| 2015/0307246 | A1 | 10/2015 | Patwardhan | |
| 2015/0307248 | A1 | 10/2015 | Patwardhan et al. | |
| 2016/0001948 | A1 * | 1/2016 | Collins | B65D 75/327 206/486 |
| 2017/0057688 | A1 | 3/2017 | Patwardhan et al. | |

* cited by examiner

PACKAGING WITH OUTER SLEEVE AND SLIDER

This application claims priority to Great Britain Patent Appln. No. GB 1604411.7 filed Mar. 15, 2016, which is herein incorporated by reference

BACKGROUND OF THE INVENTION

1. Technical Field

The present invention relates to child resistant packaging, particularly child resistant pharmaceutical packaging.

2. Background Information

Pharmaceutical products are frequently supplied in blister packs. A blister pack comprises one or more "blisters" which hold capsules, tablets or other items and whose face is sealed by a foil or other film. The blister contents are dispensed by the user pressing down on the blister, thereby pushing the contents of the blister out through the sealing film.

Typically, the blister pack is supplied in an external package from which the blister pack must be removed to dispense the blister contents. A problem with blister packs is, however, that the blister's contents may be dispensed quite easily by children. There have therefore been various proposals for making it more difficult for children to dispense contents from a blister pack. To this end, various mechanisms have been proposed to make it more difficult for a child to remove a blister pack from its external package. Typically such mechanisms comprise a locking mechanism which must be released to allow the blister pack to be accessed.

The present invention seeks to provide a further package of this type with child resistance.

SUMMARY OF THE INVENTION

According to the invention there is provided a package which comprises an outer sleeve having an open end and a closed end and a slider for holding a blister pack, the slider being slidably mounted within the outer sleeve. The outer sleeve comprises a wall having an outer panel and an inner panel. The inner panel has a locking edge formed at a terminal end thereof, the locking edge being arranged at a spacing from the closed end of the sleeve and facing the closed end of the sleeve. The slider comprises a locking flap for engagement with the wall of the outer sleeve. The locking flap is formed at a terminal end of the slider, extends in a direction away from the closed end of the outer sleeve and has a free edge for engagement with the locking edge of the inner panel of the outer sleeve wall to prevent the slider from being removed from the outer sleeve when the slider is fully received within the outer sleeve. The outer panel of the outer sleeve further comprises a release button which at least partially overlaps the locking flap of the slider when the slider is fully inserted in the outer sleeve, the release button being pressable so as to disengage the free edge of the locking flap from the locking edge of the outer sleeve wall to permit the slider to be withdrawn from the outer sleeve.

Thus withdrawal of a slide from an outer sleeve is prevented by engagement of opposed locking edges provided on the sleeve and slider. The slider can however be removed by pressing a button on the sleeve to disengage the locking edges The inner panel may be hingedly attached to the outer panel, for example at an end thereof. This allows simple and accurate positioning of the inner panel relative to the outer panel.

The outer sleeve locking edge may be formed as a folded edge. This in effect provides a two ply locking formation which may be more robust.

The release button may extend from a base region attached to the outer sleeve outer panel towards the closed end of the outer sleeve. However, that is not essential and in other arrangements, the release button may extend in a direction away from the closed end of the sleeve or at an angle thereto, for example perpendicular thereto. What is important is that the button may deflect to move the locking flap out of engagement with the locking edge of the outer sleeve.

The release button may be hingedly attached to the outer sleeve outer panel wall at the base region through a hinge line. Thus the hinge line may be arranged parallel to the closed end of the outer sleeve or at an angle thereto, for example perpendicular thereto.

The terminal end of the inner panel of the outer sleeve wall may further comprise a backing tab which at least partially overlaps the base region end of the release button. This may add a degree of resilience to the release button, encouraging the button to return to its original position after being released.

The locking edge of the outer sleeve may extend inwardly from a first side of the inner panel towards a second side of the inner panel, and the backing tab be arranged in a recess between the locking edge and the second side of the inner panel.

To avoid interference with the unlocking mechanism, the backing tab may not project beyond the locking edge in a direction towards the closed end of the container.

The release button may also extend into the recess in the terminal end of the inner panel.

The wall of the outer sleeve may further comprise a retaining flap formed at the open end of the outer sleeve for engagement with the slider locking flap to prevent full withdrawal of the slider from the outer sleeve.

In an advantageous arrangement, the retaining flap is formed as a hinged flap released from the inner panel.

The slider may comprise a first leaf holding a first blister pack and remote from the wall of the outer sleeve, a second leaf holding a second blister pack and adjacent the wall of the outer sleeve, the first leaf and second leaf joined at an end adjacent the open end of the outer sleeve, the slider flap extending from the first slider leaf towards the outer sleeve outer panel.

BRIEF DESCRIPTION OF THE DRAWINGS

An embodiment of the invention will now be described, by way of example only, with reference to the accompanying drawings in which.

DETAILED DESCRIPTION OF THE INVENTION

Figure 1:
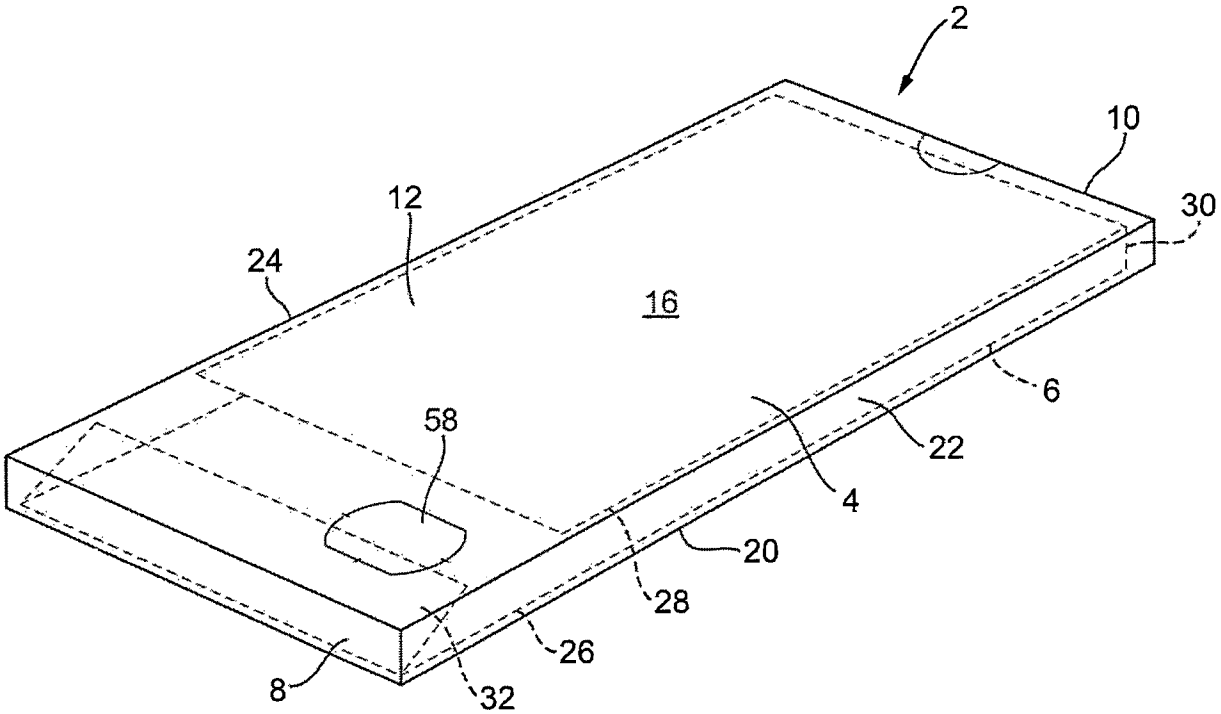
FIG. 1 shows a package in accordance with the invention.

With reference to FIG. 1, the package 2 comprises an outer shell 4 and an inner slider 6 which is slidably received in the outer shell 4. The outer shell 4 has a closed end 8 and an open end 10 through which the slider 6 may be inserted into and withdrawn from the outer shell 4. It has a first or front wall 12 which, as will be described further below, comprises components of a locking mechanism for preventing withdrawal of the slider 6 from the outer sleeve 4 and which comprises an outer panel 16 (visible in FIG. 1) and an inner panel 18 (not visible in FIG. 1). It further comprises a second or rear wall 20, opposite the first wall 12 and side walls 22, 24. The front and rear walls 12, 20 form the main faces of the outer sleeve 4. It should be understood that the terms front and rear as used are merely relative terms and do not imply any limitation as to function or orientation in use.

The slider 6 comprises a first leaf 26 and a second leaf 28 which are connected together by a connecting panel 30 at the end adjacent the open end 10 of the outer sleeve 4. Each leaf 26, 28 contains a blister pack as will be described further below. The end of the first leaf 26 remote from the connecting panel 30 comprises a folded up locking flap 32 which forms a further part of the locking mechanism as will be described further below.

Figure 2:
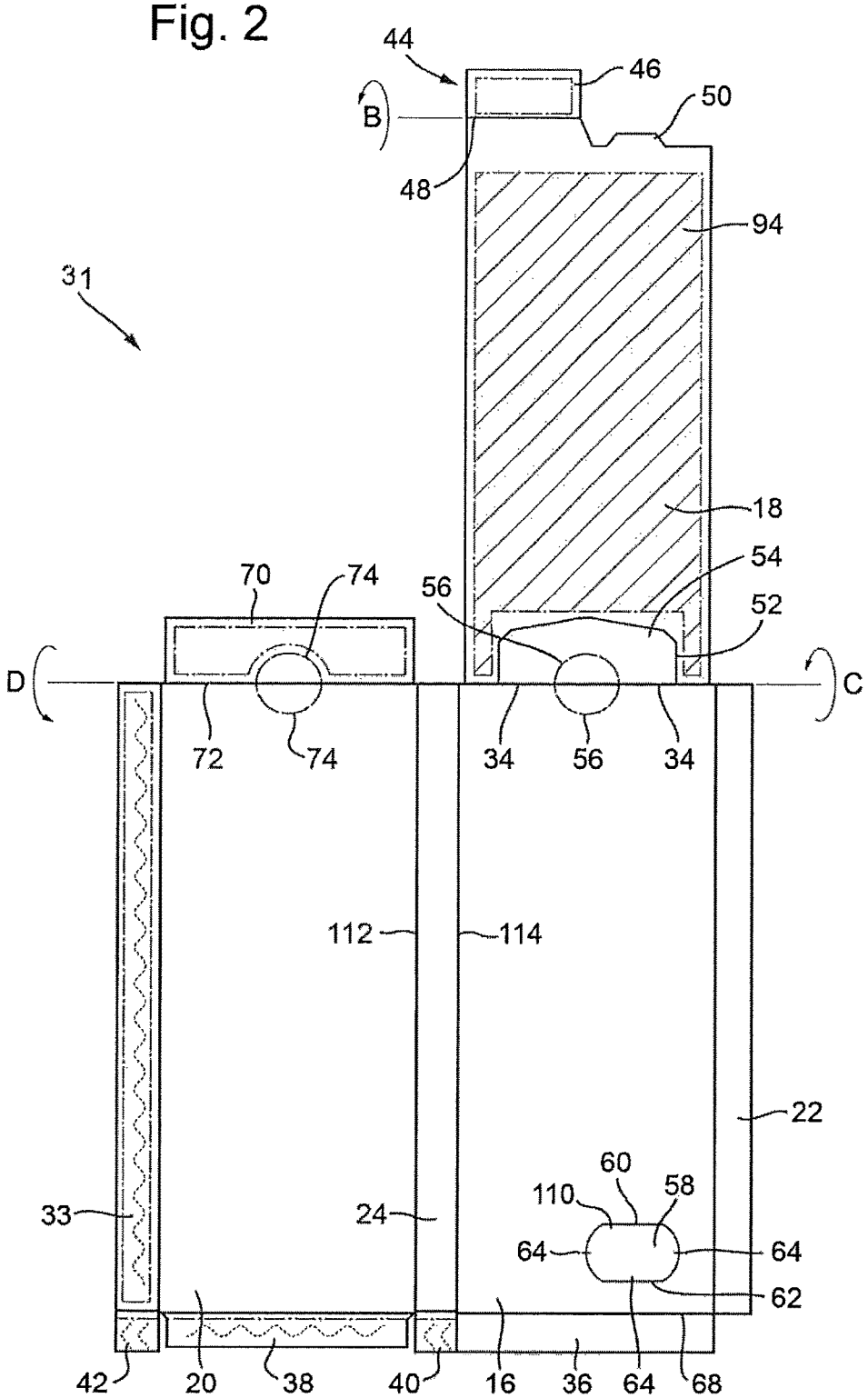
FIG. 2 shows a blank for constructing the outer shell of the package.

Turning now to FIG. 2, the outer shell 4 is formed from a blank 31 of lightweight foldable sheet material such as paperboard. The sheet material may advantageously be tear resistant. Thus in one embodiment paperboard may be coated on one or more sides with a tear resistant plastics material. The blank 31 comprises panels 18, 16 which when the blank is erected form the inner and outer panels of the outer sleeve 4. The outer and inner panels 16, 18 are joined about a hinge line 34 formed at what will be the open end 10 of the outer sleeve 4. The blank 31 further comprises a second wall panel 20, side wall forming panels 22, 24, a glue panel 33, an end wall forming panel 36 and glue panels and tabs 38, 40, 42. The respective wall forming panels are hingedly connected about respective parallel hinge lines.

The free end 44 of the inner wall panel 18 comprises a flap 46 hingedly connected to the panel 18 about a hinge line 48. The free end 44 of the inner wall panel 18 further comprises a backing tab 50 whose purpose will be described further below.

The end of the inner panel 18 adjacent the hinge line 34 is provided with a cut line 52 which defines a retaining flap 54 whose purpose will be described further below. The retaining flap 54 is provided with an arcuate line of perforations 56 or other weakening means extending from the hinge line 34. Mirror image perforations 56 are provided in the adjacent region of the outer panel 16.

The outer panel 16 comprises, at its end remote from the hinge line 34, a release button 58. The release button 58 is hingedly attached to the outer panel 16 about a hinge line 60 and is further defined by a cut line 62, with one or more frangible bridges 64 of material maintaining it in position before use. The hinge line 60 in this embodiment is generally parallel to the hinge line 68 connecting the outer panel 16 to the end flap 36, so that in the erected sleeve 4, the hinge line 60 will extend parallel to the closed end 8 of the outer sleeve 4. Of course, the hinge line 60 may be arranged at an angle to the closed end 8 in other embodiments. For example, the hinge line may extend perpendicular to the hinge line 68 or at an intermediate angle thereto. In such an arrangement, the hinge line 60 may be arranged towards the adjacent side wall panel 22 to facilitate operation.

The second wall panel 20 is provided with a flap 70 hingedly attached to the second wall panel 20 about a hinge line 72. The flap 70 is provided with an arcuate line of perforations 74 or other weakening means extending from the hinge line 72. Mirror image perforations 74 are provided in the second wall panel 20.

The areas in dotted lines on glue panels and tabs 38, 40, 42, on glue panel 33, and on flap 70 and flap 46 indicate areas of adhesive application on the applicable surfaces of the panels, tabs and flaps for use in construction of the outer shell. The wavy lines on panels and tabs 33, 42, 38 and 40 indicate optional scoring which may be used to facilitate adhesion.

Figure 3:
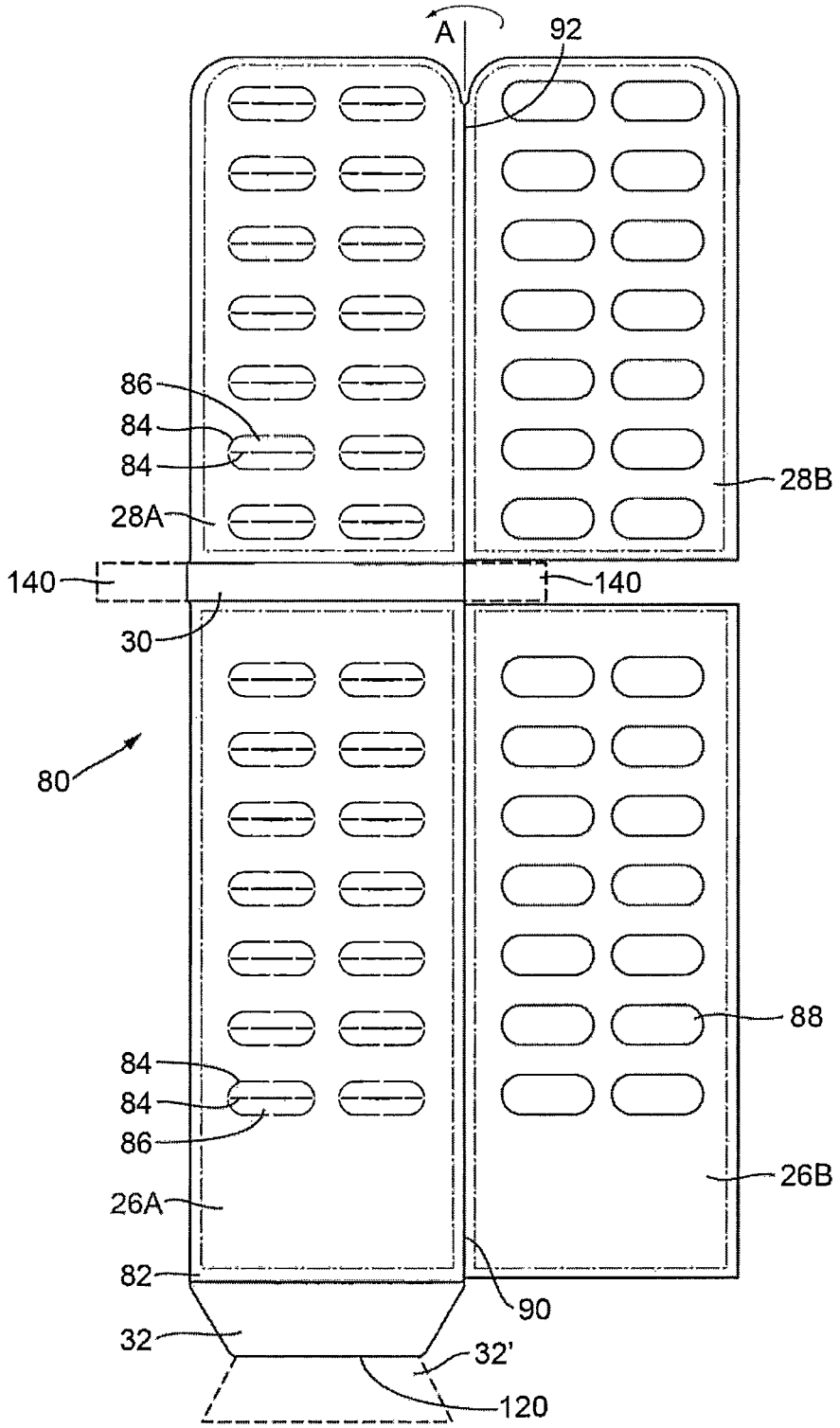
FIG. 3 shows a blank for constructing the slider of the package.

Turning now to FIG. 3, the slider 6 is also formed from a blank 80 of lightweight foldable sheet material such as paperboard. The sheet material may advantageously be tear resistant. Thus in one embodiment paperboard may be coated on one or more sides with a tear resistant plastics material. The blank 80 comprises first and second first leaf panels 26A, 26B, first and second second leaf panels 28A, 28B and connecting panel 30. The locking flap 32 is formed at the free end 82 of the first first leaf panel 26A.

The first first leaf panel 26A and first second leaf panel 28A comprise perforations or other lines of weakness 84 which define a frangible cover 86 for a blister dispensing opening. The second first leaf panel 26B and second second leaf panel 28B comprise a series of openings 88 to receive the blisters 130 of a blister pack (not shown). The panels 26A, 26B, 28A, 28B are folded over about respective hinge lines 90, 92 (as illustrated by arrow A) to retain a blister pack blister between the panels, with the blisters 130 of the blister pack protruding from the openings 88 of the second first and second leaf panels 26B, 28B and aligned with the frangible covers 86.

The construction of the outer sleeve 4 will now be described with reference to FIGS. 4 and 5.

Figure 4:
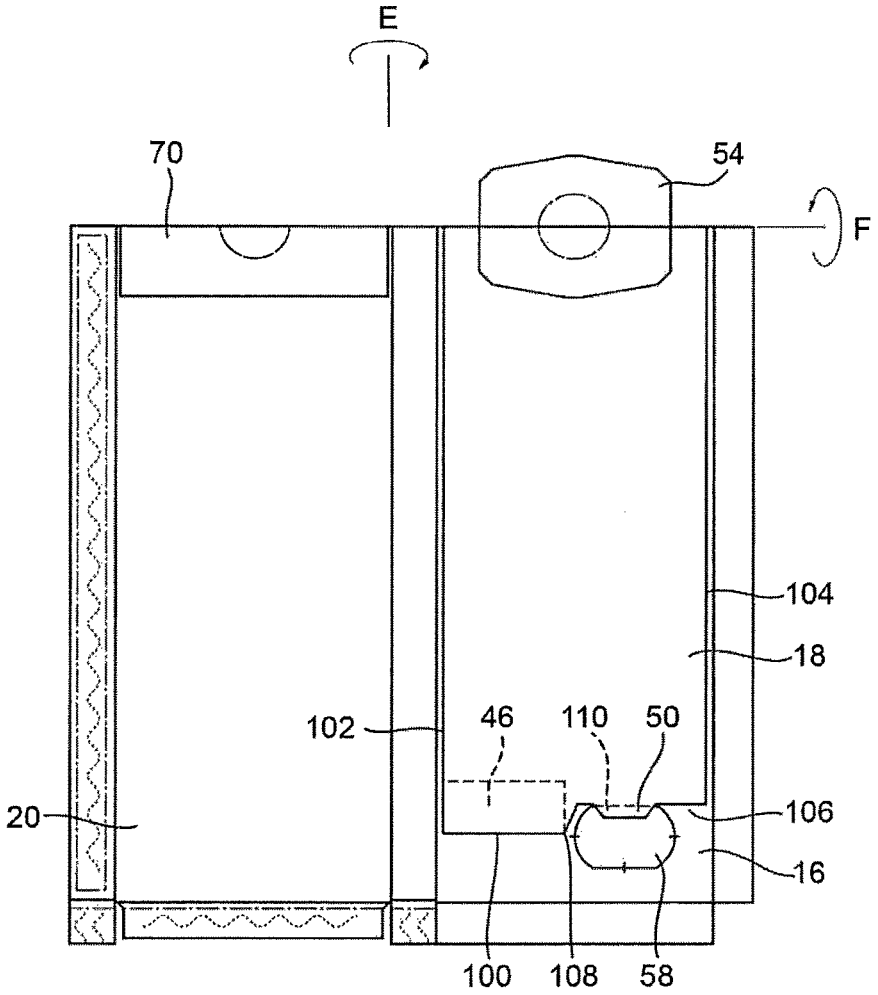
FIG. 4 shows a folded blank for the outer shell.
Figure 5:
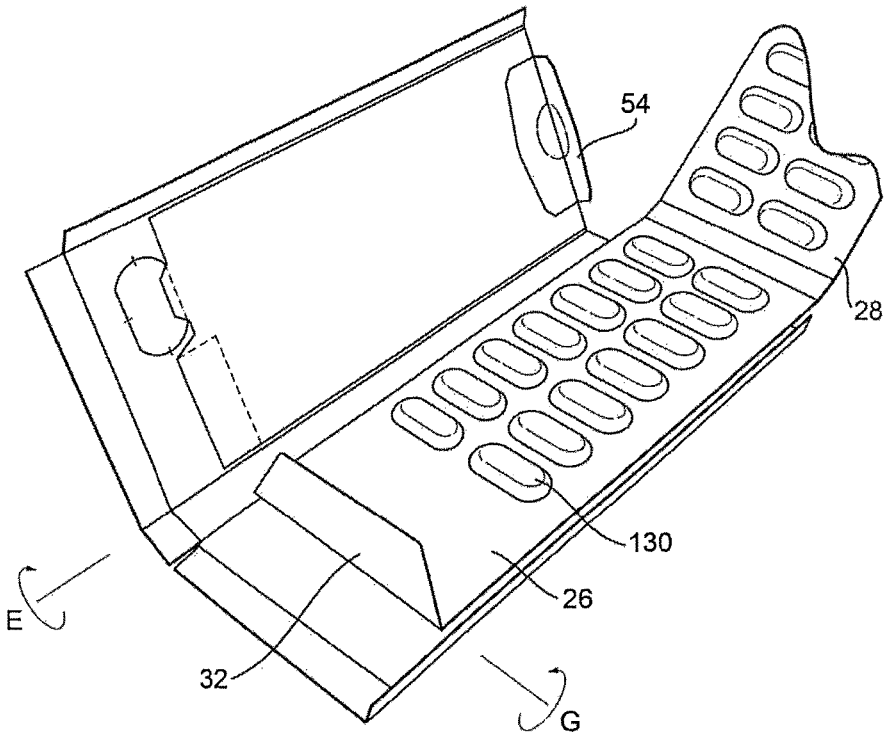
FIG. 5 shows, schematically a stage in the erection of the outer shell.

With reference to FIGS. 2 and 4, the blank 31 is first folded and glued to form an intermediate blank as shown in FIG. 4. The flap 46 attached to the inner panel 18 is folded about hinge line 48 as illustrated by arrow B and glued down to the inner panel 18. The inner panel 18 is then folded over the outer panel 20 about hinge line 34 as illustrated by arrow C. The inner panel 18 is then glued to the outer panel 20 in a gluing region 94. This area excludes the flap 54 which, as it is defined by a cut line 52 remains unfolded, as illustrated in FIG. 4.

In the folded and glued state, as shown in FIG. 4, the hinge line 48 at the base of flap 46 forms a locking edge 100 which extends inwardly from a first side edge 102 of the inner panel 18 towards the opposed side edge 104.

The release button 58 extends into a recess 106 formed in the end of the inner panel 18 between the end 108 of the locking edge 100 and the opposed side edge 104 of the inner panel 18 and does not overlap the locking edge 100.

The backing tab 50 of the inner panel extends into the recess 106 and overlaps a base region 110 of the button 58 adjacent the button hinge line 60. The backing tab 50 is not glued to the release button 58 so as to allow the relative sliding movement between the two components. In other embodiments, however, the backing tab 50 may be glued to the release button 58.

The flap 70 on wall panel 20 is folded about hinge line 72 as illustrated by arrow D and glued down to the panel 20, as shown in FIG. 4. This flap 70 does not contribute to any locking activity but simply serves to strengthen the open end 10 of the outer sleeve 4 and provide a folded rather than exposed edge.

The outer sleeve 4 may then be erected by folding the glued blank about the hinge lines 112, 114 (illustrated schematically by arrow E) and retaining flap 54 folded over the inner panel 18. The sleeve 4 may then be glued into a tubular configuration using the glue panel 33. The bottom of the sleeve 4 may then be folded over and glued using glue tabs 38, 40, 42. The retaining flap 54 is not glued to the inside of the sleeve 4, but simply projects resiliently into the sleeve 4.

The slider 6 may then be inserted into the outer sleeve 4. This is illustrated schematically in FIG. 5, although with the sleeve 4 shown prior to final folding for clarity purposes.

Figure 6:
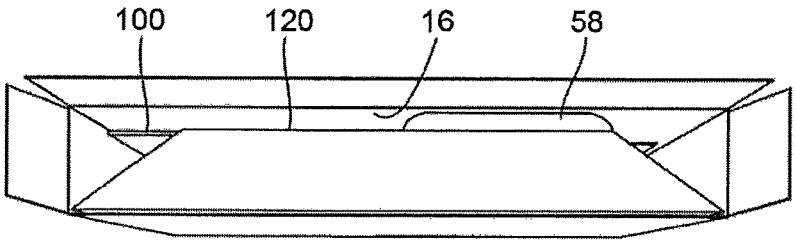
FIG. 6 shows a view of the package with the closed end opened for clarity.

The locking flap 32 of the slider 6 is folded in the direction of arrow G. The locking flap 32 resiliently engages the inner panel 18 of the outer sleeve wall 12. As the slider 6 is inserted into the outer sleeve 4, it will ride along the inner panel 18 until such time as its free edge 120 passes over the locking edge 100 on the inner panel 18. The resilience of the locking flap 32 then biases the locking flap 32 into contact with the outer panel 16. It will be understood that should a user then try to withdraw the slider 6 from the outer sleeve 4, this will be prevented by the engagement of the free edge 120 of the locking flap 32 and the locking edge 100 of the inner panel 18. This is illustrated in FIG. 6.

Figure 7:
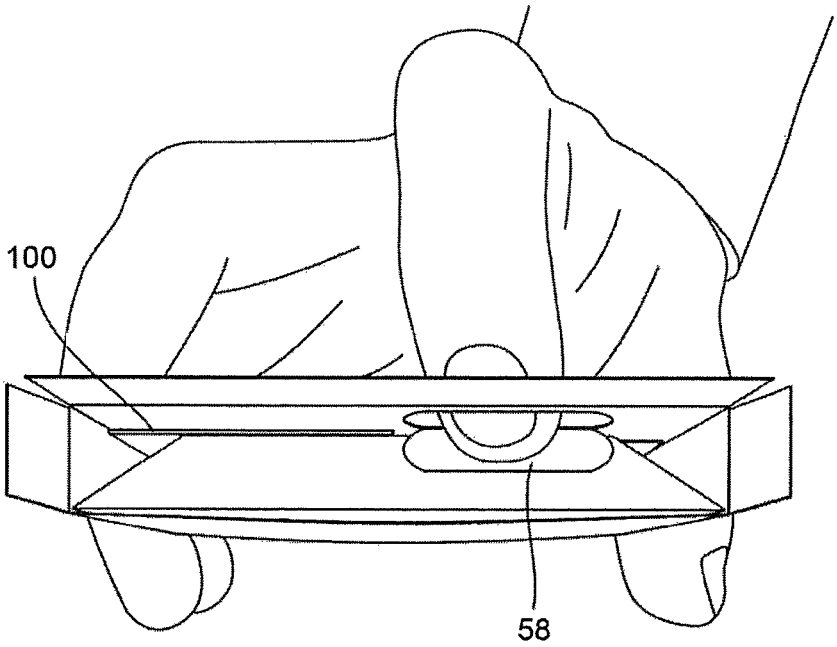
FIG. 7 shows the releasing of the slider, again with the closed end opened for clarity.

Should a user wish to remove the slider 6 from the outer sleeve 4, he or she must firstly break the perforations 56, 74 provided at the open end 10 of the outer sleeve 4. This creates arcuate recesses in the open end 10 of the outer sleeve 4 so that a user can grip the slider 6. The user must then press the release button 58 inwardly. Pressing the release button 58 will break the retaining bridges 64 and move the release button 58. The release button 58 will then contact the locking flap 32 and pivot it inwardly as shown in FIG. 7, which disengages the locking edges 100, 120 of the inner panel 18 and the locking flap 32 respectively. The slider 6 can then be withdrawn from the outer sleeve 4 to access the blister packs carried by the slider 6.

It should be noted that the slider 6 cannot be fully withdrawn from the outer sleeve due to the retaining flap 54. When the slider 6 is withdrawn from the outer sleeve 4, the locking flap 32 will engage behind the flap 54 preventing full removal of the slider 6. The slider 6 can, however, be moved sufficiently far to allow the first and second leaves 26, 28 of the slider 6 to be opened (as illustrated in FIG. 4) to allow access to the blisters 130 of the blister packs. The contents of the blisters can then be dispensed through the frangible covers 86 in the slider 6.

While the release button 58 has some inherent resilience, it will be appreciated that after repeated use, it may tend to remain depressed. However, the backing tab 50 which underlies the base region 110 of the release button 58 provides additional resilience. This helps ensure that the locking flap 32 will still be able to engage with the locking edge of the inner panel 18 after repeated use.

It will be appreciated that the above is a description of an exemplary embodiment only and that various modifications can be made to the embodiment without departing from the scope of the invention.

For example, it may be possible to provide the locking edge 100 of the inner panel 18 as a cut edge rather than a folded edge by omitting the flap 46. Alternatively, or additionally, the locking edge 120 of the slider could be formed as a folded edge, for example by providing a further panel 32' (shown in phantom in FIG. 3) which can be folded over and glued to the locking flap 32.

In a further modification, anti-roll flaps 140 may be attached to the connecting panel 30 of the slider 6 as shown in phantom in FIG. 3. These flaps will resist the second slider leaf 28 from rotating relative to the first slider leaf 26 when the slider 6 is within the outer sleeve 4 to prevent a child "rolling" the second leaf 28 out of the outer sleeve 4 and thereby possibly grip the second leaf 28 to pull it fully out of the outer sleeve 4.

Rather than using a slider formed from a single piece blank as shown in FIG. 3, it will be appreciated that the slider blank may be formed from multiple pieces joined together. For example, a slider blank with two leaves as shown in FIG. 3 may instead be constructed using two pieces, one providing the first first leaf panel 26A and the first second leaf panel 28A, and one providing the second first leaf panel 26B and the second second leaf panel 28B. Thus, rather than having panels connected along the hingelines 90, 92 as in the FIG. 3 embodiment, a two piece blank of this type could be obtained by cutting the blank shown in FIG. 3 along the hingelines 90, 92.

Also, the slider 6 need not have opposed first and second leaves 26, 28 and a single leaf slider may also be used. In such a construction, the slider may be provided with side walls extending upwardly from the slider leaf. Such a slider may similarly be formed from a single piece or multi-piece blank as in the multiple leaf slider embodiments.

As discussed above, the release button 58 need not be positioned as shown and it may be positioned in any position where it is able to deflect the locking flap 32 of the slider 6. Thus it may be attached to the outer panel 16 along a side region of the outer panel so as to deflect inwardly from the side. It may also be attached adjacent the closed end 8 of the outer sleeve so as to deflect inwardly from that end. In the former arrangement at least, a backing tab 50 can still be provided as in the earlier embodiment.

Also, while the locking edge 100 of the inner panel 18 has been shown as extending partially across the end of the inner panel from one side, it may be positioned differently, for example displaced inwardly from the side of the panel, for example centrally of the inner panel 18. In other embodiments it may extend across the entire end of the inner panel 18.

These and other modifications are intended to fall within the scope of the invention as defined by the following claims.

What is claimed is:

1. A package comprising:

an outer sleeve having an open end and a closed end;

a slider for holding a blister pack, the slider being slidably mounted within the outer sleeve;

the outer sleeve comprising a wall having an outer panel and an inner panel, the inner panel having a locking edge formed at a terminal end thereof arranged at a spacing from the closed end of the sleeve and facing the closed end of the sleeve;

the slider comprising a locking flap formed at a terminal end and extending in a direction away from the closed end of the outer sleeve for engagement with the said wall of the outer sleeve, the flap having a free edge for engagement with the locking edge of the inner panel of the outer sleeve wall to prevent the slider from being removed from the outer sleeve when the slider is fully received within the outer sleeve; and wherein the outer panel of the outer sleeve further comprises a release button at least partially overlapping the flap of the slider when the slider is fully inserted in the outer sleeve, the release button being pressable so as to contact the slider flap and disengage the free edge of the slider flap from the locking edge of the outer sleeve wall to permit the slider to be withdrawn from the outer sleeve;

wherein the release button extends from a base region attached to the outer sleeve outer panel, wherein the release button is hingedly attached to the outer sleeve wall at the base region through a hinge line, and wherein the inner panel of the outer sleeve wall further comprises a backing tab partially overlapping the base region of the release button;

wherein the locking edge extends inwardly from a first side edge of the inner panel towards a second side edge of the inner panel, the backing tab being arranged between the locking edge and the second side edge of the inner panel.

2. The package as claimed in claim 1, wherein the inner panel is hingedly attached to the outer panel about another hinge line.

3. The package as claimed in claim 1 wherein the locking edge is formed as a folded edge.

4. The package as claimed in claim 1 wherein the release button extends from the base region towards the closed end of the outer sleeve.

5. The package as claimed in claim 1, wherein the release button extends from the base region at an angle to the closed end of the outer sleeve.

6. The package as claimed in claim 1, wherein the release button extends from the base region perpendicularly to the closed end of the outer sleeve.

7. The package as claimed in claim 1, wherein the backing tab projects into a recess formed in the terminal end of the inner panel between an end of the locking edge and the second side edge of the inner panel.

8. The package as claimed in claim 7, wherein the backing tab does not project beyond the locking edge in a direction towards the closed end of the container.

9. The package as claimed in claim 7 wherein the release button extends into the recess in the terminal end of the inner panel.

10. The package as claimed in claim 1, wherein the wall of the outer sleeve further comprises a retaining flap formed at the open end of the outer sleeve for engagement with the slider flap to prevent full withdrawal of the slider from the outer sleeve.

11. The package as claimed in claim 10, wherein the retaining flap is formed as a hinged flap released from the inner panel.

12. The package as claimed in claim 1, wherein the slider comprises a first leaf holding a first blister pack and remote from the wall of the outer sleeve, a second leaf holding a second blister pack and adjacent the wall of the outer sleeve, the first leaf and second leaf joined at an end adjacent the open end of the outer sleeve, the locking flap extending from the first slider leaf towards the outer sleeve wall.

* * * * *